United States Patent [19]

Hogg

[11] Patent Number: 4,542,876

[45] Date of Patent: Sep. 24, 1985

[54] SINGLE SPRING ADJUSTABLE PLATE HANGER

[75] Inventor: James W. Hogg, Nashville, Tenn.

[73] Assignee: Anchor Wire Corporation, Goodlettsville, Tenn.

[21] Appl. No.: 559,104

[22] Filed: Dec. 7, 1983

[51] Int. Cl.[4] ..... A47G 1/16

[52] U.S. Cl. ..... 248/491

[58] Field of Search ..... 248/488, 490, 491; 24/546

[56] References Cited

U.S. PATENT DOCUMENTS

| | | | |
|---|---|---|---|
| 711,056 | 10/1902 | Larkin | 248/491 |
| 1,010,633 | 12/1911 | Jacobson | 248/490 |
| 2,128,703 | 8/1938 | Grandman | 248/491 |
| 2,266,266 | 12/1941 | Ritter | 24/546 |
| 2,488,243 | 11/1949 | Schneir | 248/491 |
| 2,604,286 | 7/1952 | Meline | 248/491 |
| 2,826,384 | 3/1958 | Brown | 248/491 |
| 2,899,154 | 8/1959 | Zavolner | 248/491 |
| 4,103,446 | 8/1978 | Maglott | 248/490 |
| 4,148,114 | 4/1979 | Wier | 24/564 |

FOREIGN PATENT DOCUMENTS

| | | | |
|---|---|---|---|
| 553233 | 12/1956 | Italy | 248/491 |
| 7454 | of 1906 | United Kingdom | 248/491 |
| 678629 | 9/1952 | United Kingdom | 248/491 |

*Primary Examiner*—J. Franklin Foss

*Assistant Examiner*—Robert A. Olson

*Attorney, Agent, or Firm*—Fisher, Christen & Sabol

[57] ABSTRACT

A plate hanger has a single spring to connect two plate-gripping members. The plate-gripping members may be formed identically to one another. Each plate-gripping member is formed of wire, the wire having a coating which, first, allows the wire to be formed; second, increases the frictional gripping capability of each plate-gripping member; and third, prevents the plate-gripping members from scratching either a wall surface or the plate which is held. Each plate-gripping member is formed generally in the shape of a "W", the ends of the "W" terminating in hooked portions so as to grip an edge of a plate. The middle of the "W"-shaped plate-gripping member is formed as a wire loop for securing one spring end, as well as a threequarter loop which connects the two "V"-shaped portions of the "W"-shaped wire plate-gripping member. In use, a plate edge is received into curved-in end portions of one plate-gripping member, the other plate-gripping member is then placed along an opposite plate edge. The spring is attached to both plate-gripping members so that the spring resiliently urges the two plate-gripping members toward one another. The plate hanger may then be secured to a wall by passing the second, nearly complete, loop portion over a nail, projection, or other type of wall hanger.

7 Claims, 11 Drawing Figures

FIG. 1
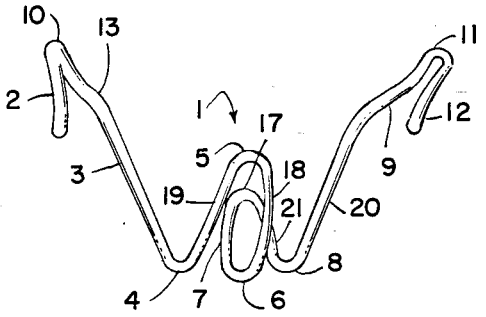
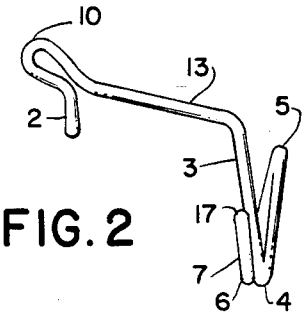
FIG. 2
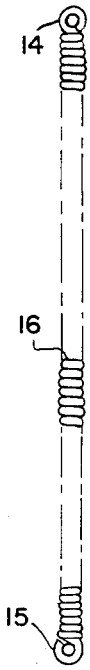
FIG. 3
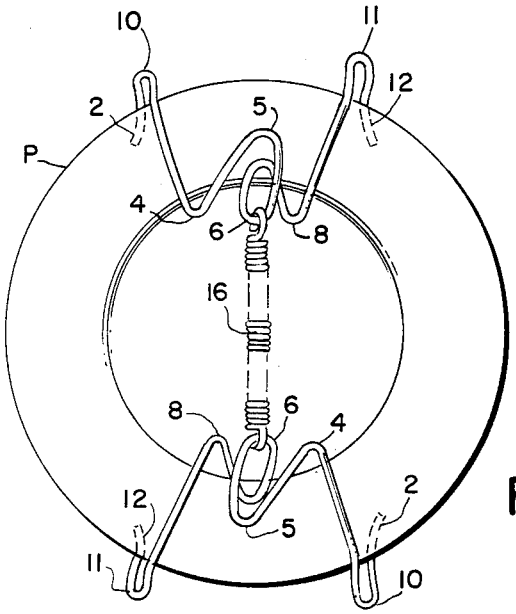
FIG. 4

FIG. 5
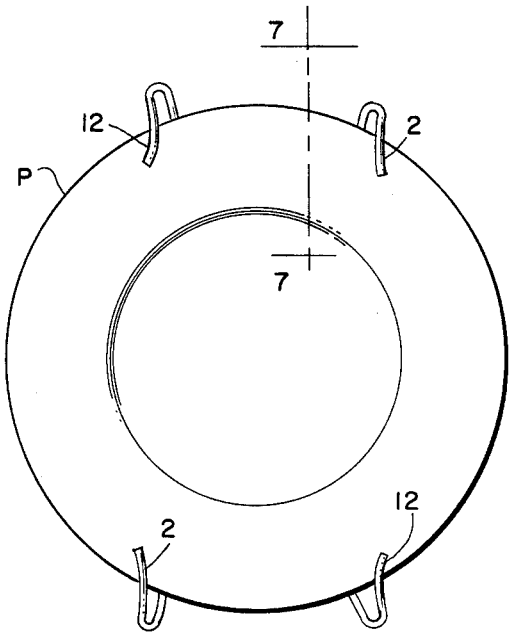
FIG. 7
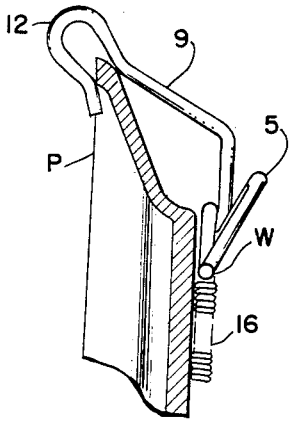
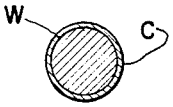
FIG. 8
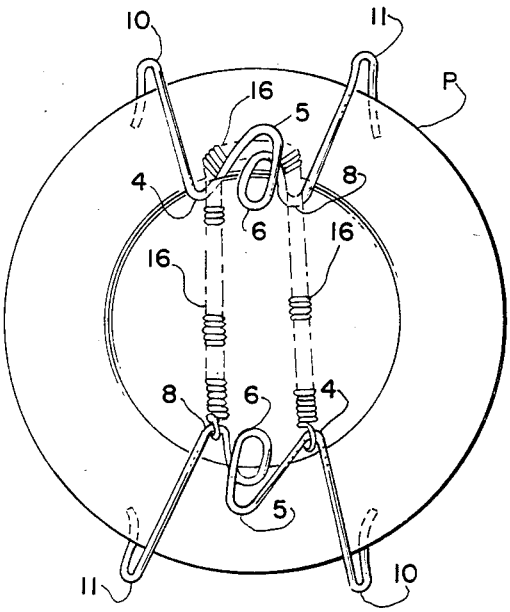
FIG. 6
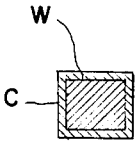
FIG. 9
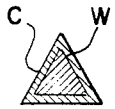
FIG. 10
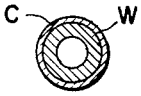
FIG. 11

SINGLE SPRING ADJUSTABLE PLATE HANGER

BACKGROUND OF THE INVENTION

This invention relates to devices for grasping the rim of plates and dishes of various kinds and supporting them by a hanger mounted upon a wall, in cabinets, racks, or in any other places where it may be desirable to exhibit them.

This invention may also be used to hang any relatively rigid, somewhat planar or planar article from any projection or hanger attached to a generally vertical surface.

This invention may also be used to make a readily attachable handle for carrying any portable article. In this case, no hanger is used, rather the spring portion connecting the two gripping portions may be manually gripped for ease of handling.

This invention may also be used for protecting articles which are prone to be scratched, and in this case the article need not be hung or mounted at all. If the article is hung, however, it will prevent scratching of the wall or damage to fine bone china or any other articles prone to scratching or which are easily damaged.

It is well-known to use plate hangers having plate-gripping members formed of wire. It is also known to use plate hangers having two plate-gripping members which are resiliently biased toward one another by a spring.

The prior art plate hangers as described above have several drawbacks. The prior art plate hangers are relatively expensive to manufacture. Furthermore, the prior art plate hangers are prone to scratching or damaging both the plate and the wall to which the plate is secured as by hanging. Also, the prior art plate hanger materials are difficult to form and therefore must be made of sufficiently malleable materials, having the proper thickness, so as to resist breaking when formed.

Frequently, it is desirable to hang plates of different sizes for display purposes. In this case, prior art hangers generally cannot be made to accommodate a wide range of plate sizes. Nonetheless, some adjustment is sometimes provided in the prior art plate hangers, however this adjustment is achieved only at the expense of greater complexity and greater use of materials.

A first type of plate hanger having at least two wire plate-gripping members connected to one another by a resilient member is disclosed by Brown in U.S. Pat. No. 2,826,384 and Schneir in U.S. Pat. No. 2,488,243.

Brown discloses a plate hanger having two somewhat "W"-shaped plate-gripping members and to "I"-shaped plate-gripping members, connected to one another by a resilient member having two ends. Both ends of the resilient member are connected to one of the "W"-shaped plate gripping members. The resilient member is attached first at the first "V"-shaped portion of the "W"-shaped plate-gripping member through a loop formed at one end of a first "I"-shaped plate-gripping member through a first "V"-shaped portion of a second plate-gripping member, through a second "V"-shaped portion of the second "W"-shaped plate-gripping member, through a loop formed in a second "I"-shaped plate-gripping member and terminating at a second "V"-shaped portion of the first plate-gripping member. Each of the plate-gripping members has at least one end formed in a hook shape so that the hook-shaped end may grip an edge of a plate inserted therein. This type of plate hanger is bulky, relatively expensive to manufacture, and is relatively difficult to initially assemble onto the plate.

Schneir shows a plate hanger having two "W"-shaped plate gripping members, four springs, and a spring-separating element. The "W"-shaped plate-gripping members each engage an edge of the plate, while the strings resiliently bias the "W"-shaped members toward one another. The spring-separating member biases two pairs of springs apart. Each spring has an end engaging a loop formed in one or another of the "W"-shaped plate-gripping members. In one embodiment, the lower "W"-shaped plate-gripping member has no middle raised portion and therefore cannot be used for hanging from a hook or nail mounted on a wall. Instead, the upper plate-gripping member has a middle portion formed in the shape of a nearly closed loop which is adapted to receive a hook, nail, or other projection for mounting upon a wall. This device also is relatively complex, and is relatively difficult to assemble onto a plate. It is relatively expensive to manufacture and must be formed of materials sufficiently thick and malleable so as to resist breaking when formed.

In a second type of plate hanger, two generally "V"-shaped plate-gripping members are used in conjunction with a third member used for hanging. The members are generally resiliently biased toward one another by a spring. Typical of the plate hangers of this type for hanging a plate upon a wall are the hangers disclosed by Meline in U.S. Pat. No. 2,604,286 and Larkin in U.S. Pat. No. 711,056.

In Meline, two "V"-shaped plate-gripping members are resiliently biased toward one another by a spring. A third member, used for hanging the plate hanger to a wall, has a first end formed in a loop about the middle portion of the lower "V"-shaped plate-gripping member, is extended through the middle of the spring, and then extended between the arms of the top "V"-shaped plate-gripping member. In addition, the third member is constrained for sliding engagement with the middle of the top "V"-shaped plate-gripping member. This construction is relatively complex, expensive to make, difficult to form without breaking due to the large number of bends, and is relatively difficult to assemble and hang. Also, due to the constraints requiring sliding engagement of the hanging member and of the top plate-gripping member, the plate hanger is not completely adjustable, e.g., non-circular objects requiring non-symmetrical placement of the plate-gripping members cannot generally be accommodated.

Larkin shows a similar plate hanger, having two relatively "V"-shaped plate-gripping members resiliently biased toward one another by a spring. A hanger member is attached at a bottom end of the spring and extends upward beyond an edge of the plate and between the plate and the top "V"-shaped plate-gripping member. A connecting member connects two sides of the wire hanger across a side of the spring opposite the plate so that the spring lies between the plate and the connecting member. Here too, the plate hanger of Larkin is relatively complex, relatively difficult to assemble, and relatively expensive to manufacture. Also, due to the large number of ends and connections required, it must be formed of materials which are malleable and sufficiently thick to resist breaking.

SUMMARY OF THE INVENTION

It is accordingly one object of the present invention to provide an improved plate hanger which is inexpensive to fabricate, requires no complex assembly, is convenient to use, and that can be formed from readily available materials.

Another object of the invention is to provide an improved plate hanger having two plate-gripping members connected by a resiliently flexible member such as a spring, which members can be easily placed over opposing edges of a plate.

Another object of the present invention is to provide an improved plate hanger which does not require a separate hook-receiving portion, and which when attached to a plate can be readily mounted upon a nail or hook attached to a wall.

A further object of the present invention is to provide an improved plate hanger which includes a coating on the plate-gripping members so as to prevent scratching of either the plate or wall surfaces.

A still further object of the present invention is to provide an improved plate hanger having plate-gripping members formed of wire which is bent into a gripping configuration so that manufacturing expenses are minimized.

Another further object of the present invention is to provide an improved plate hanger formed of wire plate-gripping members which are coated with a resilient material so as to facilitate bending and forming of the plate-gripping members to their proper shapes without breakage of the wire.

Another further object of the present invention is to provide an improved plate hanger formed of wire plate-gripping members which are coated with a resilient material so as to greatly enhance the frictional grip between the plate-gripping members and the plate, so as to resist the tendency of the hanger members to slip relative to the plate under the influence of small vibrations.

A still further object of the present invention is to provide an improved plate hanger having two plate-gripping members, each of which is formed generally in a "W" shape with the center of the "W" having three bends so that the two arms of each plate-gripping member are resiliently adjustable along the edge of the plate.

A still further object of the present invention is to provide an improved plate hanger having two generally "W"-shaped plate-gripping members wherein the end of each arm of the "W" is hooked to form a plate-receiving portion and wherein a centrally located portion of each arm is bent so as to enable the central loops of the "W"-shaped plate-receiving member to lie generally parallel to a base of the plate and the hook end portions to receive the edges of the plate without significantly straining the plate-gripping member.

Another object of the present invention is to provide an improved plate hanger having two plate-gripping members formed of wire and a connecting spring therebetween, wherein the connecting spring has looped ends through which the entire length of either plate-gripping member may selectively be maneuvered.

Another object of the present invention is to provide an improved plate hanger having two plate-gripping members, each plate-gripping member formed in the general shape of a "W", the ends of each arm of the "W" being shaped so as to receive an edge of the plate, wherein the plate-receiving edge is configured in the shape of the loop having two generally parallel sides to receive and grip an edge of the plate connected by a bent section of the plate-gripping member and terminating at the extremity of each arm in a short portion bent away from the received plate so that an entry guide is formed for the plate leading into the parallel portions of the plate-gripping member which thereby resiliently and snugly grip the plate while facilitating ease of assembly.

A still further object of the present invention is to provide an improved plate hanger having two plate-gripping members, each plate-gripping member being formed generally in the shape of a "W", the plate-gripping members being connected to one another by a resilient member, wherein the resilient member may be connected selectively either from a central loop of one plate-gripping member to a central loop of another plate-gripping member, or from the first "V"-shaped portion of a first plate-gripping member, behind the middle loops of the second plate-gripping member and back to the other "V"-shaped portion of the first plate-gripping member, thereby allowing the same resilient member to be used with different sized plates and still maintain a proper amount of tension between the two plate-gripping members.

A still further object of the present invention is to provide an improved plate hanger having two plate-gripping members, each formed in the shape generally of a "W", wherein each plate-gripping member contacts a plate at four points so as to provide stability to the plate while it is mounted.

Another object of the present invention is to provide an improved plate hanger formed to two plate-gripping members, each plate-gripping member being formed of coated wire formed into the general shape of a "W", wherein the central portion of the "W" is formed by three bends of the wire such that the lower bend can be used to mount the resilient member, and the upper end formed by a bend may be used to hang the plate-gripping member from a hook or nail protruding from a wall so as to hang the plate upon the wall for display.

It is a still further object of the present invention to provide a plate hanger having two wire, "W"-shaped, plate-gripping members, wherein the middle of each "W" is formed by three wire bends so as to form two generally oval-shaped portions one of which is smaller than the other, wherein the smaller oval underlies the larger oval so that when mounted to a plate the smaller oval contacts the plate.

It is a further object of the present invention to provide a plate hanger having two wire, "W"-shaped, plate-gripping members wherein a central portion of each "W" is formed by three wire bends so as to form two generally oval-shaped portions, one larger than the other, the smaller one underlying the larger one so as to contact the plate when in use, there being sufficient clearance between the contacting wire portions of each loop so that a spring loop end may pass therebetween or alternatively that the wire be sufficiently resilient that the loops may be easily spread apart so as to form a clearance therebetween for passage of a wire loop end.

It is a still further object of the present invention to provide an improved plate hanger wherein two edge gripping members may be adapted to grip any object having relatively thin edges, the gripping members being connected by a resilient member which may also serve as a manually engagable portion for being manually grasped so as to carry the object engaged by the edge gripping members.

The improved plate hanger of the present invention comprises a pair of light-weight, "W"-shaped wire members wherein each extremity of each of "W"-shaped portion is bent so as to receive an edge of a plate. The middle of each "W"-shaped plate-gripping member is formed generally in a shape of two ovals, formed by three wire bends. The pair of ovals connect the two "V"-shaped portions which define the "W" shape. The ovals are different sizes, the larger oval-shaped portion overlying the smaller oval-shaped portion so that the smaller oval-shaped portion contacts a plate when in use. Sufficient clearance exists between the two generally oval-shaped portions such that a wire loop slidably engagable with and surrounding the wire forming the plate-gripping member may pass between the large oval and the small oval loop.

A pair of plate-gripping members may be connected together by a flexible, resilient member having a loop at each end which can engage the middle of the "W"-shaped portion, especially the bottom of the smaller generally oval-shaped portion. The plate to be gripped by these members must be sufficiently large that the resilient member is stretched or tensioned by the two plate-gripping members once they are engaged at opposing edges of the plate. If the plate is not sufficiently large to tension the resilient member, a first loop of the resilient member may be passed over the wire member end to the bottom of a first "V"-shaped portion of the plate-engaging member; the body of the resilient member is then passed behind the central loops of the other plate-engaging member and the hitherto free end of the resilient member is passed concentrically over the second end of the first plate-engaging member so that it finally rests at the bottom of the second "V"-shaped portion of the first plate-engaging member. This effectively halves the length of the spring and doubles the theoretical spring constant of the resilient member.

Each plate-gripping member is coated with a coating that facilitates bending of the wire member so as to form loops and plate-engaging ends. Also, the coating prevents marring of either the plate or the wall to which the plate is ultimately mounted. Additionally, the coating provides for greater frictional engagement of the bent plate-receiving ends of the plate-gripping member.

Because of the "W"-shaped configuration of each plate-gripping member, the edge-receiving ends of each plate-gripping member may be adjustably positioned either closer or away from each other along the edge of a plate due to the inherent resiliency and frictional grip of the "W"-shaped portion including the two oval-shaped loops and the arms. Additionally, each "W"-shaped plate gripping member is bent at a point located near the central portion of each arm. The extremity of each arm is bent downwardly so that the pair of oval-shaped loops and the adjacent arms of the "W"-shaped plate-gripping member lie generally in a plane parallel to and closely spaced from the bottom of a plate which is held. Such bends therefore accommodate the curvature of a typical plate. Nonetheless, due to the presence of a linking resilient member which connects the two plate-gripping members together under tension, each plate-gripping member will still strongly grip any plate having virtually any curvature although in an extreme case, the central portions of the "W"-shaped plate-gripping members will not lie in a plane closely parallel to that of the central portion of the plate.

The extremities of each of the "W"-shaped plate-gripping members is formed so as to receive an edge of a plate. This is done by bending of the extremity into a hairpin turn having two parallel portions connected by a 180° bend. Both portions of the arm closely adjacent to the parallel portions and away from their connecting end are bent away from each other in the same plane as the hairpin bend. The edge-receiving portion then terminates a short distance away from the hairpin bend.

To assemble the plate hanger to a plate, a first plate-gripping member is positioned with the edge-receiving extremities abutting an edge of the plate. A gentle force is required to slide the edge-receiving extremity and the plate into complete engagement. When fully engaged, the plate rests snugly against the 180° bend portion of the hairpin bend. The coating on the wire facilitates frictional engagement, as does the resilient deformation of each hairpin bend to accommodate the width of the plate edge. It is assumed here that a first loop end of the resilient member has already been positioned at either a first "V" portion of the smaller oval-shaped portion of the "W"-shaped plate gripping member.

The other loop end of the resilient connecting member is then appropriately positioned, either at the bottom of the small oval loop of the second plate-gripping member or that it has been positioned through it. The second plate-engaging member is then positioned diametrically opposite to the position occupied by the first plate-gripping member. It is then similarly urged into gripping position with that plate edge portion. The resilient member then resiliently urges the two plate-gripping members together.

The larger oval-shaped loop of either "W"-shaped plate-gripping member may be used to receive along its interior portion a nail or hook-type projection protruding from a flat, vertical surface such as a wall.

The particular construction used herein enables a person to quickly mount the plate-gripping members to a plate and hang the plate upon a wall and to change the orientation of the plate by 180° merely by removing the plate from the nail or hook, rotating the plate 180° and engaging the other plate-gripping member with the nail or hook-type projection. Furthermore, either plate-gripping member may be urged upon application of sufficient force along the edge of the plate in either direction. Slight adjustment in the position of the plate may therefore easily be accomplished.

The resilient member may be a wire coil spring having a loop at each end. Also, in an alternative, the resilient member may be a rubber band wherein the rubber band forms a loop. Any suitable resilient member can be used, however. The loop may be passed about the wire which forms each plate-gripping member so as to rest in any position in which the spring end may rest. Nonetheless, any suitable object, device, or element may be used to intermediately connect the resilient member and either plate-gripping member.

Although each plate-gripping member is disclosed as being formed of coated wire, other materials can be used to form the plate-gripping members including resilient plastic; resilient steel or other metal; or any other sufficiently strong, resilient material either coated or uncoated. However, the preferred embodiment is that of coated wire for reasons of both ease of manufacture and low cost.

Further details and advantages of the present invention appear from the following description of a preferred embodiment shown schematically in the drawings.

BRIEF DESCRIPTION OF THE DRAWINGS

FIG. 1 shows a top elevational view of a "W"-shaped wire plate-gripping member used in the present invention;

FIG. 2 shows a side elevational view of the same member;

FIG. 3 shows a top elevational view of the resilient member used in the present invention;

FIG. 4 shows a pair of plate-gripping members connected by the resilient member and mounted upon a plate for use in hanging the plate upon a wall;

FIG. 5 is an elevational view of the same plate shown in FIG. 2, taken from the other side of the plate;

FIG. 6 is a top elevational view of an alternative mounting arrangement to that shown in FIG. 4;

FIG. 7 is a sectional view taken along line 7—7 of FIG. 6;

FIG. 8 is a cross-sectional view of a round coated wire for use in the present invention;

FIG. 9 is a view similar to FIG. 8, showing an alternative embodiment having a square, coated cross-sectional shape;

FIG. 10 is a view similar to FIG. 8, showing an alternative embodiment having a triangular, coated cross-sectional shape;

FIG. 11 is a view similar to FIG. 8, showing an alternative embodiment having a hollow cylindrical, coated cross-section shape.

DETAILED DESCRIPTION OF THE INVENTION

A "W"-shaped wire plate-gripping member 1 is shown in FIG. 1, prior to assembly and prior to being mounted on a plate. A first rim enaging member 2 is connected to arm portion 13 by bend 10. Arm portion 13, together with connected arm portion 3 form a first arm of the 37 W"-shaped plate-gripping member. The second arm of the "W"-shaped plate-gripping member is formed by edge-gripping member 12 connected by bend 11 to arm portion 9.

Both bend 10 and bend 11 permit flexure so that plates of varying thickness may be inserted in the respective rim engaging members. The first arm is connected to the central portion of the "W"-shaped plate-gripping member by bend 4. The second arm is connected to the central portion of the "W"-shaped plate-gripping member by bend 8. Both are resiliently flexible and permit flexure so that arms 13 and 9 may be flexed toward or away from each other either prior to mounting upon a plate or while the plate-gripping member is mounted upon a plate.

The center portion of the "W"-shaped plate-gripping member has a larger, generally oval shaped member and a smaller generally oval shaped member. The larger oval shaped member can be selectively engaged at the underside of upper bend 5 with a nail or hook so as to support the plate-gripping member when the plate-gripping member is mounted to a plate. The two oval shaped portions are formed by bend 5, bend 6, and bend 17.

A generally straight wire portion 19 connects bend 4 with bend 5. Another generally straight portion 21 connects bend 8 with bend 17. A side portion 7 forms part of both the large and the small oval and connects bend 6 with bend 17. Another side portion 18 forms part of both of the large and the small oval and connects bend 5 with bend 6.

Bend 6 can be used as a support for a resilient member 16, as can bend 4, as well as bend 8. Side portion 18 overlies the generally straight portion 21 connecting bend 17 with bend 8. FIG. 2 is a side view of the plate-gripping member 1 shown in FIG. 1 as would be seen if viewed from the left. The first rim engaging member 2 is clearly shown in FIG. 2. Also, it is seen that the first arm is bent into two sections, arm portion 3 and arm portion 13; the second arm is similarly bent so as to accommodate the curvature of a plate.

A resilient member 16 is shown in FIG. 3. The resilient member 16 in a preferred form is a spring and has wire loop ends 14, 15. As is conventional in the wire spring art, loop end 14 is formed integrally with resilient member 16. Also, loop end 15 is formed integrally with resilient member 16.

A pair of plate-gripping members 1 is shown in FIG. 4 attached to a plate "P". The plate-gripping members 1 are attached to one another by the resilient member 16. Rim engaging portions 2,12 are shown in dotted outline engaging a front face of the plate; it is seen that the remainder of the plate-gripping members 1 in FIG. 4 lie in contact with portions of the back side of plate "P". In this figure, the resilient member 16 is connected at loop end 14 and at loop end 15 to bend 6 of each of the plate-gripping members 1.

Each plate-gripping member 1 is formed from steel wire, which is coated with a resilient material such as plastic. The resilient material facilitates bending and forming of the plate-gripping members to their proper shapes without breakage of the wire. The resilient material also provides an enhanced frictional grip between the plate-gripping members 1 and the plate "P" so as to resist the tendency of the plate-gripping members to slip relative to the plate "P" under the influence of small vibrations such as would be transmitted to the assembly by a support such as a wall. Further, the resilient material prevents scratching of either the plate "P" or any wall surface to which the assembly is attached.

The rim of plate "P" is engaged with rim engaging arms 2,12 which have been resiliently deformed away from respective arm portions 13,9 so as to resiliently grip the rim of plate "P" at a total of four locations. It is not necessary for the rim of plate "P" to be received by rim engaging portions 2,12 completely into respective bends 10,11; rather, any degree of engagement of the rim of plate "P" with the tapering rim engaging member 2,12 will suffice. Resilient member 16 applies a continuous force between the two plate-gripping members 1 to draw them toward each other, thereby constantly urging the rim engaging members 2,12 of each plate-gripping member 1 against the rim of plate "P".

The assembly shown in FIG. 4 has great stability when bend 5 of either plate-gripping member 1 is hung over a nail or hook fixed to a wall or other generally vertical surface. This is so because the pair of plate-gripping members 1 contacts a plate "P" at a total of at least eight spaced locations. Each rim engaging member 2,12 of each plate-gripping member 1 engages the plate "P" at a spaced location. Also, each bend 4,8 of each plate-gripping member 1 contacts the plate "P" at a spaced location. Thus it is seen that each plate-gripping member 1, when attached to a plate "P" as shown in FIG. 4, contacts a plate "P" at least four spaced locations and thereby imparts great stability to the overall assembly due to the widely spaced contact points and the resilient bias of resilient member 16.

The wire which forms each plate-gripping member 1 may be formed of stainless steel wire; however, any deformable wire material may be used. The wire of the present invention is not limited to wire of circular cross-section but may comprise wire of any cross-section. For example, cross-sectional shapes may include triangular, rectangular, oval, pentagonal, hexagonal, and any other geometric shape either regular or irregular. Furthermore, although in a preferred embodiment the wire cross-section is both circular and of uniform cross-section, the present invention is not limited to either circular wire cross-section or uniform wire cross-section. For example, the wire "W" forming each plate-gripping member 1 may vary along its length in either cross-section or dimension or both without departing from the present invention.

Similarly, the coating "C" upon the wire "W" forming each plate-gripping member 1 may be of any resilient material including, but not limited to, plastic, rubber, silicon, or any other resilient coating material. Furthermore, instead of or in addition to a coating, the wire may be covered by any resilient material including cloth, glass, plastic sleeves, any mixture of wood particles and glue, or any other material which can be used to prevent scratching of a plate "P" by the wire material used. Note that the wire material may be stainless steel, copper, nickel, any suitably strong and resilient plastic material, formed steamed wood, dried or baked clay, bronze, ceramic material, brass, or any other material which is sufficiently strong to support a plate at rim engaging members 2,12.

The resilient member 16 need not be a metal spring, but may be any resilient elongated material having loop ends. For example, a common rubber band may be used since each end of the rubber band may be used as a loop. Pieces of elastic with a knot forming a loop at either end may be used as well. Although a simple elongate resilient member 16 is shown in FIG. 3, more complex shapes and more complex designs of resilient members may be used without departing from the spirit of the present invention; therefore, it is contemplated that any resilient member capable of contacting each plate-gripping member and urging the two plate-gripping members toward one another may be used.

FIG. 5 shows the front of plate "P", clearly showing rim engaging members 2,12 which support the plate "P". The dotted outlines of the remainder of each plate-gripping member 1 are omitted for clarity. The plate "P" is shown in FIG. 5 as it would be displayed in a preferred embodiment of the present invention.

An alternative assembly is shown in FIG. 6, in the case where greater tension is desired between plate-gripping members 1. Here, resilient member 16 is stretched from a first "V"-shaped bend 4 around and behind the larger oval of the other plate-gripping member 1 and back to engage with bend 8 of the first plate-gripping member 1. Thus, the resilient member 16 is stretched to approximately twice the length of the arrangement shown in FIG. 4. Thus, plates of varying diameter may be easily accommodated merely by varying the spring arrangement, since the required tension of resilient member 16 is predetermined by the weight of plate "P" together with the weight of the lower plate-gripping member 1, since the upper plate-gripping member 1 will be supported by a nail or hook from a wall. The lower plate-gripping member 1 therefore supports the weight of the plate as well as its own weight, while the upper plate-gripping member 1 retains the plate against the wall and against rotation about any horizontal axis.

Therefore, a single pair of plate-gripping members 1 may be used with a single resilient member 16 to provide a plate hanger that is adjustable for a wide variety of plate sizes. It is therefore economical, practical, easy to use, and more stable than the prior art plate hangers.

A cross-sectional view of plate "P", taken along line 7—7 of FIG. 5, is shown in FIG. 7. Here it is clearly seen how rim engaging member 12 contacts the rim of plate "P". Also, it is clearly seen how the plate-gripping member 1 lies against the back of a plate "P". Note that, in FIG. 7, the wire "W" forming the plate-gripping member 1 is shown in cross-section at bend 4. Although a particular plate "P" is shown in FIG. 7, any plate of any curvature or shape may be held by the plate-gripping members 1. For example, the plate may be thick or thin, square, oval, or rectangular, or may be of bowl shape or may be completely flat. In each case, so long as the plate thickness does not exceed the greatest separation of the rim engaging members 2,12 from respective portions 13,9 and so long as the resilient members 16 can be stretched to accommodate two generally opposing predetermined rim portions, the plate hanger of the present invention composed of two plate-gripping members 1 and a resilient member 16 may be used to hang such plate upon a wall.

Note that although each plate gripping member 1 is shown generally in the shape of a "W", more complex shapes may be used although such is not the present preferred embodiment. For example, additional bends, twists, arms or loops may be added to the shape of each plate-gripping member 1 without departing from the scope of the present invention. Additionally, the wire forming each plate-gripping member 1 may be hollow if desired regardless of the cross-sectional shape used.

FIG. 8 is a cross-sectional view of the coated wire used in the plate-gripping member 1 of the present invention. The coating "C" need not be uniform. The wire "W" in FIG. 7 is circular.

An alternative cross-sectional shape of wire is shown in FIG. 9. A wire "W" having square cross-section is shown, having a coating "C".

The triangular cross-sectional wire "W" is shown in FIG. 10, and has a coating "C".

A hollow tubular wire "W" is shown in FIG. 11, and has a coating "C".

The improved plate hanger of the present invention is capable of achieving the above enumerated objects and while preferred embodiments of the present invention have been disclosed, it will be understood that it is not limited thereto but may be otherwise embodied within the scope of the following claims.

I claim:

1. A plate hanger for mounting a plate to a wall comprising in combination:

a first plate-gripping member having two spaced ends, each end of said first plate-gripping member being adapted to receive a first portion of a rim of a plate to be displayed;

said plate-gripping member having an intermediate loop portion connecting said ends;

a second plate-gripping member having two other ends, each said other end of said second plate-gripping member being adapted to receive a second portion of a rim of a plate to be displayed;

said second plate-gripping member having an intermediate loop portion connecting said other ends;

a means for tensioning having a predetermined unstretched length which is adapted to engage said intermediate loop portion of said first plate-gripping member and said intermediate loop portion of said second plate-gripping member; whereby said first and second plate-gripping members can be urged toward one another so as to retain a plate therebetween;

said intermediate loop portions of said plate-gripping members includes a wire bent at three locations so as to form an overlying oval-shaped loop portions and an underlying oval-shaped loop portion, said larger oval-shaped loop portion being adapted to engage a projection to support a plate upon a wall;

a first "V"-shaped portion connecting one of said two spaced ends of said plate-gripping members to a region of said wire adjacent said overlying oval-shaped loop portion;

a second "V"-shaped portion connecting the other one of said two spaced ends of said plate-gripping members to a region of said wire adjacent said underlying oval-shaped loop portion;

said means for tensioning including an elongated member having two free ends and which is elastically resilient; each of said two free ends having a means for attachment to a wire member.

2. A plate hanger as claimed in claim 1, wherein each one of said two spaced ends of said first plate-gripping member include an open wire loop which is resiliently deformable to engage rims of plates of varying thicknesses.

3. A plate hanger as claimed in claim 1, wherein each one of said two spaced ends of said second plate-gripping member include an open wire loop which is resiliently deformable to engage rims of plates of varying thicknesses.

4. A plate hanger as claimed in claim 1, wherein each of said first and second plate-gripping members are entirely of wire.

5. A plate hanger as claimed in claim 1, wherein each of said first and second plate-gripping members are further comprised of wire having a coating of resilient material.

6. A plate hanger as claimed in claim 4, wherein said wire has generally uniform, circular cross-section.

7. A plate hanger as claimed in claim 5, wherein said wire is steel wire and said coating is plastic material said coating provides greater frictional contact with a plate than bare wire along so that small existing vibrations do not cause movement of the plate-gripping member relative to the plate after the plate has been mounted to a wall.

* * * * *